US007387205B1

(12) United States Patent
Wilson

(10) Patent No.: US 7,387,205 B1
(45) Date of Patent: Jun. 17, 2008

(54) PACKAGING SYSTEM FOR PRESERVING PERISHABLE ITEMS

(75) Inventor: Charles I. Wilson, Shepherdstown, WV (US)

(73) Assignee: The United States of America as represented by the Secretary of Agriculture, Washington, DC (US)

( * ) Notice: Subject to any disclaimer, the term of this patent is extended or adjusted under 35 U.S.C. 154(b) by 352 days.

(21) Appl. No.: 11/271,695

(22) Filed: Nov. 10, 2005

(51) Int. Cl.
*B65D 85/84* (2006.01)

(52) U.S. Cl. ..... 206/524.4; 206/204; 206/524.1

(58) Field of Classification Search ..... 206/204, 206/205, 213.1, 524.1, 524.4; 426/124, 133
See application file for complete search history.

(56) References Cited

U.S. PATENT DOCUMENTS 3,338,285 A * 8/1967 Jaster et al. ..... 383/65
4,664,922 A 5/1987 Leon et al.
4,813,791 A * 3/1989 Cullen et al. ..... 383/40
4,861,632 A * 8/1989 Caggiano ..... 428/35.2
5,241,149 A * 8/1993 Watanabe et al. ..... 219/725
6,106,876 A 8/2000 Tipler et al.
6,119,855 A * 9/2000 Yeager et al. ..... 206/213.1
6,213,294 B1 * 4/2001 Colombo ..... 206/213.1
6,269,945 B1 * 8/2001 Colombo ..... 206/213.1
6,520,323 B1 2/2003 Colombo
6,530,471 B1 * 3/2003 Tsuyuguchi ..... 206/204
6,821,594 B2 * 11/2004 Watanabe et al. ..... 428/40.1
2002/0079238 A1 * 6/2002 Wilson et al. ..... 206/204
2002/0175218 A1 * 11/2002 Uranaka et al. ..... 239/56

* cited by examiner

*Primary Examiner*—David T Fidei
(74) *Attorney, Agent, or Firm*—John Fado; G. Byron Stover

(57) ABSTRACT

A packaging system for preserving perishable items which involves a thermoplastic reclosable bag or container wherein the thermoplastic reclosable bag or container involves sealed means for closing one end of the thermoplastic reclosable bag or container, and an external patch for delivering active packaging materials (e.g., chemicals) into the thermoplastic reclosable bag or container, and means for flowing active packaging materials into the thermoplastic reclosable bag or container from the external patch into the thermoplastic reclosable bag or container. Such packaging can perform a number of functions such as moisture regulation, antimicrobial emission, ethylene scavenging, ethylene emission, antioxidant emission, flavor adsorption and emission, and oxygen and carbon dioxide regulation. The present invention allows the segregation of active compounds in plastic packaging within an external patch that prevents the direct contact of such compounds and the contents of the package but allows the free exchange of liquids and/or gasses between the patch contents and the package interior.

5 Claims, 6 Drawing Sheets

PACKAGING SYSTEM FOR PRESERVING PERISHABLE ITEMS

BACKGROUND OF THE INVENTION

The present invention relates to a packaging system for preserving perishable items which involves a thermoplastic reclosable bag or container wherein the thermoplastic reclosable bag or container involves sealed means for closing one end of the thermoplastic reclosable bag or container, and an external patch for delivering active packaging materials (e.g., chemicals) into the thermoplastic reclosable bag or container, and means for flowing active packaging materials into the thermoplastic reclosable bag or container from the external patch into the thermoplastic reclosable bag or container.

Plastic containers play an important role in the packaging and storage of foods, medicines, and other goods. Plastics in packaging can perform a variety of tasks including physical protection of the contents and control of the package atmosphere and moisture. Modified Atmosphere Packaging (MAP), made possible by the gas exchange properties of plastics, is used to package fruits, vegetables, baked goods, fresh and processed meats, and cooked poultry. Through this process, fresh produce and other food products can be packaged in controlled atmospheres that maintain the carbon dioxide/oxygen ratio at an optimum level, thus greatly extending the shelf life of these commodities.

"Active Packaging" is being developed that responds to environmental conditions in packages and modifies these conditions to extend the freshness of commodities placed in them. Controlling the gaseous environment in plastic packages is an important aspect of active packaging. In order to do this, a variety of gas scrubbers and emitters have been developed. For example, ethylene is a gaseous natural plant hormone that accelerates ripening in a number of fruits and vegetables. Build-up of ethylene inside a package during storage or transportation can cause premature ripening and accelerated senescence, leading to significant deterioration of organoleptic and physical properties of produce prior to reaching its destination. Ethylene scavenging technologies are being developed to reduce this undesirable build up of ethylene in plastic packages.

Active packaging technologies also exist to control the concentrations of oxygen and carbon dioxide inside the package. These take the form of oxygen scavengers and carbon dioxide emitters/scrubbers. Oxygen scavenging technologies are generally based on one of the following concepts: iron powder oxidation, ascorbic acid oxidation, photosensitive dye oxidation, and enzymatic oxidation. The majority of presently available oxygen scavengers are based on the principle of iron oxidation. Sachets containing chemicals that react to scavenge oxygen are placed in plastic packages to reduce their oxygen content. Some important iron-based $O_2$ absorbent sachets are Ageless® (Mitsubishi Gas Chemical Co., Japan); ATCO®; $O_2$ scavenger (Standa Industrie, France); Freshilizer® (Toppan Printing Co., Japan); Vitalon (Toagosei Chem. Industry Co., Japan); Seagul (Nippon Soda Co., Japan); Fresh Pax® (Multisorb Technologies, Inc., U.S.A.); and O-Buster® (Dessicare, LTD., U.S.A.). Oxygen scavenging plastics have been developed to reduce the oxygen level in plastic containers. The oxygen scavenging chemicals can be incorporated into packaging material such as polymer film, labels, and liners.

Sachets and films are also used as delivery systems for antimicrobial compounds that are introduced into the headspace of active packaging. Examples include chlorine dioxide, silver salts, bacteriocins, ozone, and natural essential oils such as hinokitiol and rosemary. Commercial ethanol emitters also exist (e.g., Ethicap, Antimold 102 and Negamold (Freund Industrial); Oitech (Nippon Kayaku); ET Pack (Ueno Seigaku); and Ageless type SE (Mitsubishi Gas Chemical) (Day 1998). These films and sachets contain absorbed ethanol in a carrier material that allows the controlled release of ethanol vapors.

All of the above active package technologies are applied either in sachets that are placed in the package or incorporated into the plastic (e.g., through a film) that comprises the plastic package. These two means of applying active packaging technologies have considerable problems. The introduction of sachets into packages may allow for the possible accidental ingestion of the contents of the sachet by the consumer. Another concern is that the contents of the sachet will leak out and contaminate the product. Also, when sachets are used there needs to be a free flow of air surrounding the sachet for maximum efficiency. A major problem with $O_2$ and ethylene scavenging packaging film is that the film reacts with the atmosphere prior to its use thereby reducing its intended effectiveness.

The present invention solves problems that presently exist in sachet and film delivery systems for active packaging. It discloses a patch for plastic packages that sequesters active packaging compounds on the outside of the package while allowing free gas and moisture exchange between the contents of the package and the patch. This configuration overcomes the disadvantages stated above for active packaging utilizing sachets and films. The reactive chemicals used for scavenging and emitting active compounds can exist in a dry un-reactive form in the external patch until moisture from the package contents activates them. Having the contents of the patch sequestered outside the package prevents it accidental ingestion or spillage into the package.

SUMMARY OF THE INVENTION

In accordance with the present invention there is provided a packaging system for preserving perishable items that involves a thermoplastic reclosable bag wherein the thermoplastic reclosable bag or container involves sealed means for closing one end of the thermoplastic reclosable bag or container, and an external patch for delivering active packaging materials (e.g., chemicals) into the thermoplastic reclosable bag or container, and means for flowing active packaging materials into the thermoplastic reclosable bag from the external patch into the thermoplastic reclosable bag or container.

DETAILED DESCRIPTION OF THE INVENTION

Figure 1:
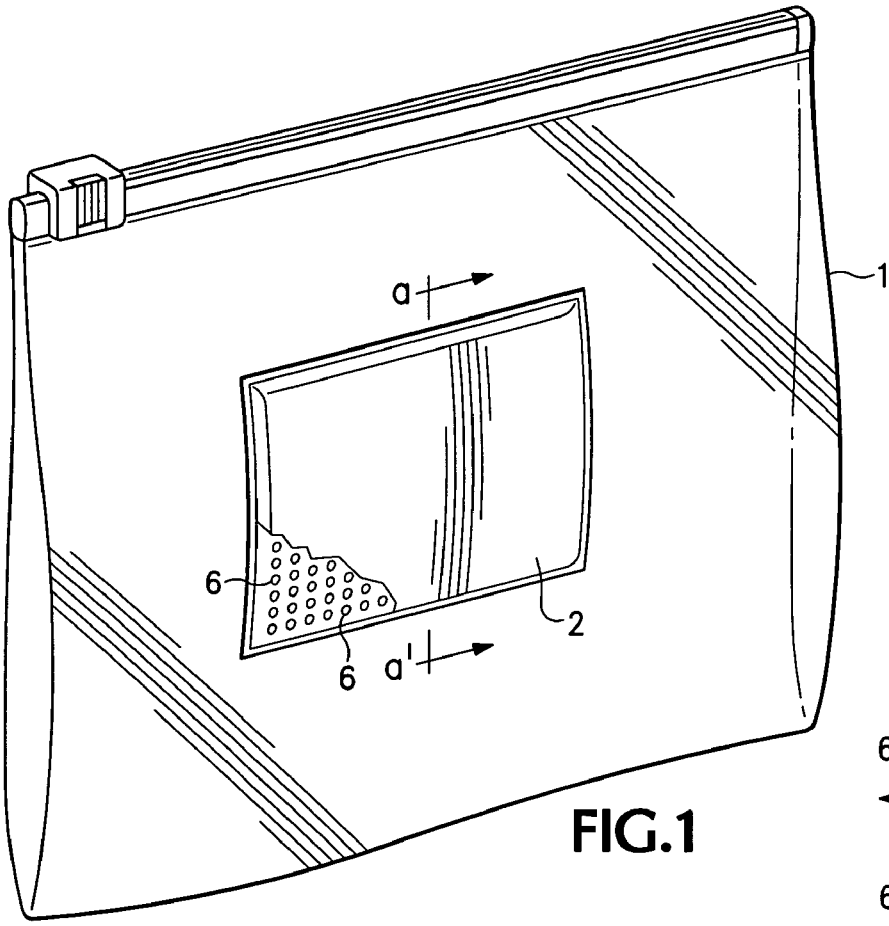
FIG. 1 shows a thermoplastic reclosable bag with external delivery patch attached.

The present invention concerns a packaging system for preserving perishable items that involves a thermoplastic reclosable bag (or container) wherein the thermoplastic reclosable bag involves sealed means for closing one end of the thermoplastic reclosable bag, and an external patch for delivering active packaging materials (e.g., chemicals) into the thermoplastic reclosable bag, and means for flowing active packaging materials into the thermoplastic reclosable bag from the external patch into the thermoplastic reclosable bag.

As noted above, "active packaging" is being developed that modifies conditions within food storage packages in response to environmental changes. Examples of active packaging materials are ethylene scrubbers and oxygen scrubbers that reduce these gases within food storage bags and containers and extend the shelf life of produce. Carbon dioxide generators and scavengers are also used in active packaging; in addition, antimicrobial compounds are used to extend produce freshness. To date the chemicals used for active packaging are introduced into storage bags and containers by means of sachets or plastic films. Both methodologies have considerable shortcomings and a need exists for safer and more efficient methods.

The present invention sequesters the reactive chemicals involved in active packaging outside the main body of the food storage bag or container. As the same time it allows the free exchange of gasses and moisture between the bag contents and the sequestered chemical. This eliminates the two major concerns with the use of sachets in active packaging: that sachets may be accidentally eaten by the consumer or their contents may spill into the package.

This invention also overcomes problems that develop when chemicals for active packaging are incorporated into plastic films. Such chemicals become reactive once they are exposed to the atmosphere before commodities are placed in the package. In the present invention the active packaging chemicals either remain un-reactive in the external patch until activated by the moisture from the commodity placed in the package or are displaced from the surface of a carrier in the patch by moisture from the commodity. This is not the case with reactive chemicals placed in plastic films.

The external patch may be created by attaching a piece of gas and moisture impermeable plastic to the outside of a plastic bag or container and sealing (e.g., by heat) its edges to the bag or container. This creates a pocket that can be used to contain reactive chemicals required for an active package. Perforations are made in the bag or container in the area under the attached plastic piece to allow the free flow of air and moisture between the interior of the patch and the interior of the plastic bag or container. These perforations or pores may be created by methods known in the art, such as the application of a template to the plastic surface containing needles so as to penetrate the plastic creating pores that are consistent in diameter and distribution. This plastic bag or container configuration can be used to enclose active packaging compounds involved in ethylene and oxygen scrubbers, carbon dioxide and ethanol emitting, off flavor scrubbing, moisture removal, taint removal, antimicrobial volatile release, and odor absorption.

FIG. 1 shows an example of the packaging system of the present invention. Thermoplastic reclosable bag 1 may be a plastic food storage bag known in the art. Exterior patch 2 is attached to the exterior of thermoplastic reclosable bag 1 in order to sequester active packaging materials (e.g., reactive chemicals) outside the bag. Perforations 6 in the bag between the exterior patch and the interior of the bag allow the free flow of gasses and moisture between the contents of the exterior patch and the headspace of the bag. The perforations 6 (or pores) have a diameter generally ranging from about 0.75 mm-about 1.2 mm.

Figure 2:
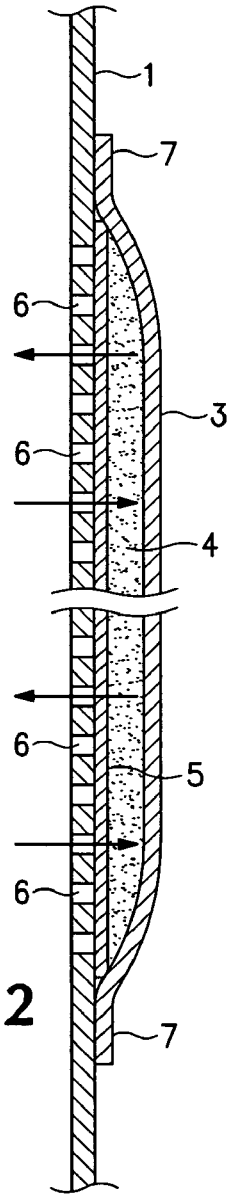
FIG. 2 shows cross sectional view (a-a') of external delivery patch attached to a thermoplastic reclosable bag.

FIG. 2 shows the a-a' cross-sectional view from FIG. 1. The exterior wall 3 of the patch is composed of a gas and moisture impermeable plastic and is attached to the bag, for example by heat fusion 7 along the margins of the exterior wall; for example, one can use a heated (270° C.) press that would melt the impermeable plastic layer to the bag, thereby creating a stable, reliable seal that leaves no opportunity for active packaging materials (e.g., chemicals) generated or contained within the patch to travel anywhere but into the bag headspace. A sheet of thin, permeable, and highly absorbent paper 5 or other moisture absorbent material or other carrier known in the art, such as cloth or cellulose fibers, is placed against the perforations 6 in the bag thus separating the reactive chemicals 4 from the bag 1; the absorbent paper is slightly smaller in size than the exterior wall 3 and may serve as a carrier for the chemicals. The reactive chemicals and absorbent paper are enclosed inside the gas and moisture impermeable plastic wall 3 that comprises the outside of the patch.

In one embodiment of the invention the active packaging materials in the exterior patch can contain ethylene scavenging chemicals known in the art, such as potassium permanganate-impregnated alumina pellets, potassium permanganate, activated carbon, activated carbon+Pd-catalyst, activated carbon+bromine type inorganic compounds, and zeolites.

In another embodiment of the invention the active packaging materials in the exterior patch can contain oxygen scavengers known in the art, such as iron, catechol, ascorbate/metallic salts, ascorbate/sulphite, photosensitive dye/organic compounds, cobalt catalyst/nylon polymer, and enzyme based scavengers.

In still another embodiment of the invention the active packaging materials in the exterior patch can be carbon dioxide generating combinations known in the art, including a mixture of a carboxyl acid and a base. The carboxylic acid can be any acid that, when reacted with a base, results in the production of carbon dioxide. The carboxyl acid can be aliphatic or aromatic, preferably tartaric acid. In a most preferred embodiment, the base is sodium bicarbonate. Generally the carboxyl acid and base are in solid form (e.g., granular, powder).

In still another embodiment of the invention, the active packaging materials in the exterior patch can be ethanol placed on carriers such as silica gel and placed in the patch where ethanol is emitted into the package when released by moisture from the package entering the interior of the external patch and displacing the ethanol.

In still another embodiment of the invention, the active packaging materials can be volatile antimicrobial compounds known in the art, such as 1-octen-3-one, 3-octanol, ethyl pyruvate, propionic acid, trans-3-octen-2-one, chlorine dioxide, and essential oils, fragrance and flavor compounds that can be placed on carriers such as silica gel, zeolite, or kaolin clay. The volatile antimicrobial compounds are emitted into the package when moisture from the package enters the interior of the external patch and displaces the volatile antimicrobial compounds on their carriers.

In still another embodiment of the invention moisture can be removed from the package by placing active packaging materials (i.e., moisture absorbing compounds such as silica gel or hydrophilic clays) in the external patch.

In still another embodiment of the invention, off-flavor or tainting compounds can be removed selectively from the package by active packaging materials (i.e., reactive or adsorbing compounds such as activated charcoal or zeolites) in the external patch.

In still another embodiment of the invention, active packaging materials (i.e., moisture emitting carriers such as hydrated absorbent pads) can be placed in the external patch to add moisture to the package interior.

In still another embodiment of the invention, any of a number of combinations of active packaging materials described herein can be placed in the external patch for ethylene scavenging/emission; oxygen scavenging/emission; moisture control; antimicrobial emission; carbon dioxide emission/scavenging; ethanol emission; taint removal; and odor removal. For example, carbon dioxide emissions can potentiate the anti-microbial activity of volatile compounds such as hexanol to preserve lettuce.

The perishable goods which may advantageously be protected by the packaging system of this invention include oxygen-sensitive food such as, e.g., fruits, vegetables, red meat (veal, beef, pork, etc.), pasta, cooked food, and the like. Alternatively, one may preserve perishable non-food items such as photographic film, computer components, inorganic materials susceptible to oxidation, etc.

Regardless of the particular gas and moisture impermeable thermoplastic bag or container used, it is preferred that it have an oxygen permeability of less than about 5 cubic centimeters per 100 square inches per 24 hours, as measured by a suitable gas permeability measuring device; measurements are taken under ambient conditions. This test method is well know, being described in A.S.T.M. Standard Test D-1434 "Test Method for Determining Gas Permeability Characteristics of Plastic Film and Sheeting." Reference may also be had to U.S. Pat. Nos. 5,913,445, 5,882,518, 5,769,262, 5,684,768, and the like.

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are now described.

The following examples are intended only to further illustrate the invention and are not intended to limit the scope of the invention as defined by the claims.

EXAMPLES

The following examples demonstrate the ability of the external patch to either deliver carbon dioxide through a moisture-activated system or to deliver a volatile compound with the ability to preserve store-bought commodities beyond their shelf-life when contained in storage bags.

In all of these examples the design of the patch itself was consistent. Pores were made in commercial storage bags (Glad Storage Bags) using a template of fixed needles, which, when forced through one side of the storage bag created holes covering a 1.5"×1.5" area with each hole having a diameter in the range of 0.75-1.2 mm. A section of very thin and very absorbent paper (Kimberly-Clark Kimwipes EX-L) was placed over the area containing the holes on the outside of the bag. The compound or mixture to be delivered was next placed directly onto the paper. The patch was fixed to the bag by placing a section of gas and moisture-impermeable plastic, which was slightly larger than the section of absorbent paper, over the other components and fixing it to the bag by heat-sealing. This ensured that any compound generated by moisture activation, or any volatile compounds applied directly to a carrier and allowed to volatilize, would not escape into the atmosphere through the patch but would instead be forced into the headspace of the bag.

My research focused earlier on the use of a porous compartment at the bottom of the storage bag that relied on the gravitational movement of water toward the compartment at the bottom of the bag. The obvious shortcomings of such a design are the unwanted potential contact between the preservative compound and the commodity itself and the reliance of the system on the actual position of the bag during storage.

Example 1

Testing involving a moisture activated system focused on the use of a carbon dioxide generation mixture consisting of 2.06 g of sodium bicarbonate and 1.84 g of tartaric acid. The basic premise of these experiments was that the absorbent paper would sequester free moisture created by the commodity while being stored under refrigeration. The absorption of water by the absorbent paper would expose the water to the sodium bicarbonate/tartaric acid mixture via direct contact, with the result of this reaction being the generation of carbon dioxide gas. The carbon dioxide gas would then migrate into the headspace of the bag and have a preservative effect on the commodity itself enclosed in the bag.

Approximately 100 g of chopped lettuce were added into each bag and all bags were stored under refrigeration at 4° C. The carbon dioxide generation mixture was stored either in the patch as described or in a porous compartment at the bottom of the bag. Storage bags containing no patch or porous compartment were also used in testing as controls. Carbon dioxide and oxygen levels were measured within each bag using a Mocon Pac Check headspace analyzer over the course of the experiment so that any differences in preservation between bags containing the sodium bicarbonate/tartaric acid mixture and controls could be correlated with differences in carbon dioxide (and oxygen) levels. Lettuce was assessed by comparing the weight of the degraded or rotten leaves with the total weight of all the leaves in the bag in order to arrive at a percentage of rotten leaves. Average values of this parameter were then calculated to arrive at final comparisons between treatments.

Figure 3:
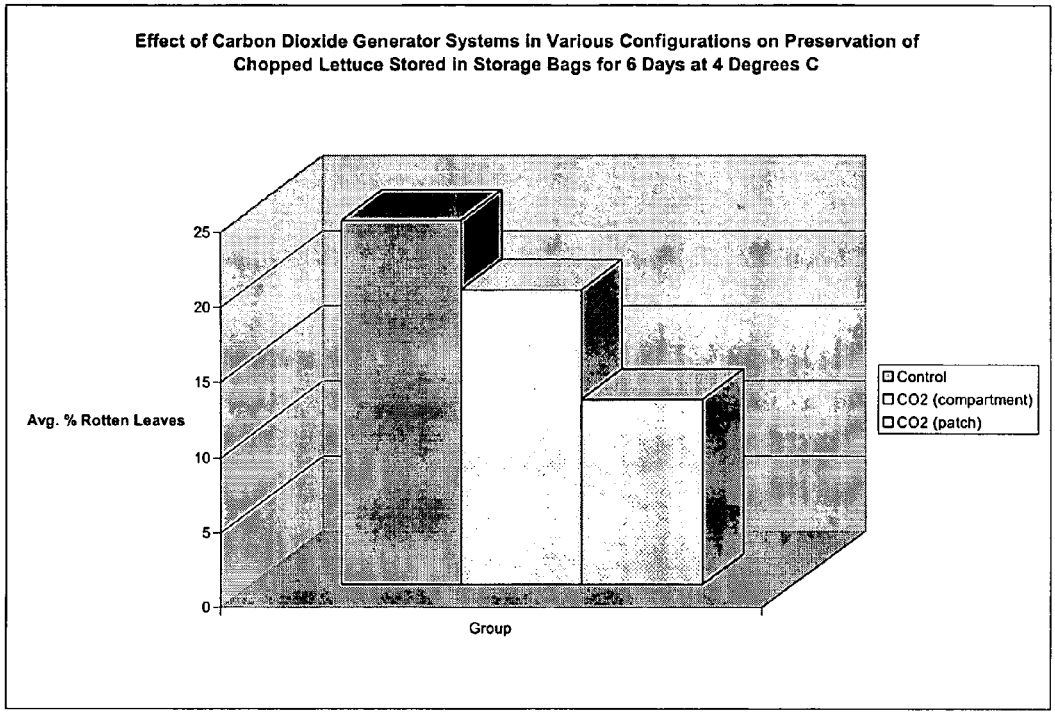
FIG. 3 shows comparison of the preservation effect of storage bags containing carbon dioxide generation patches to bags containing compartmentalized carbon dioxide generators and to control bags (chopped lettuce was stored in storage bags for six days at 4° C.).
Figure 4:
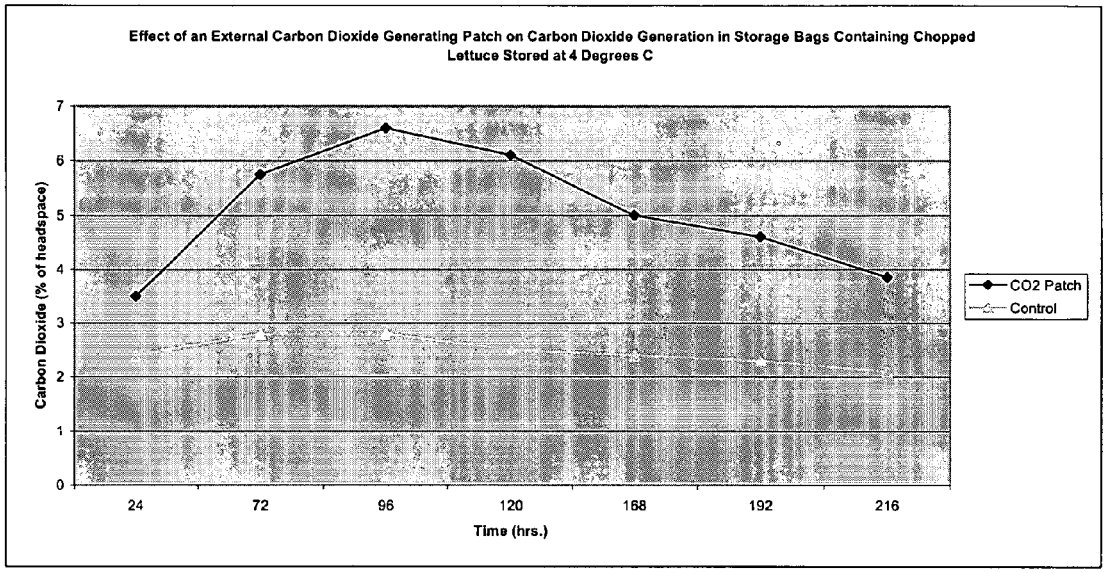
FIG. 4 shows comparison of carbon dioxide levels when chopped lettuce is stored in bags both with and without an external carbon dioxide generating patch present (chopped lettuce was stored in storage bags at 4° C.).

Surprisingly, use of the patch was more effective in preserving chopped lettuce than the use of a bottom compartment and was vastly superior to the control group (see FIG. 3). This result correlated well with elevated levels of carbon dioxide in bags containing an external carbon-dioxide generating patch in comparison with control bags (see FIG. 4).

Figure 5:
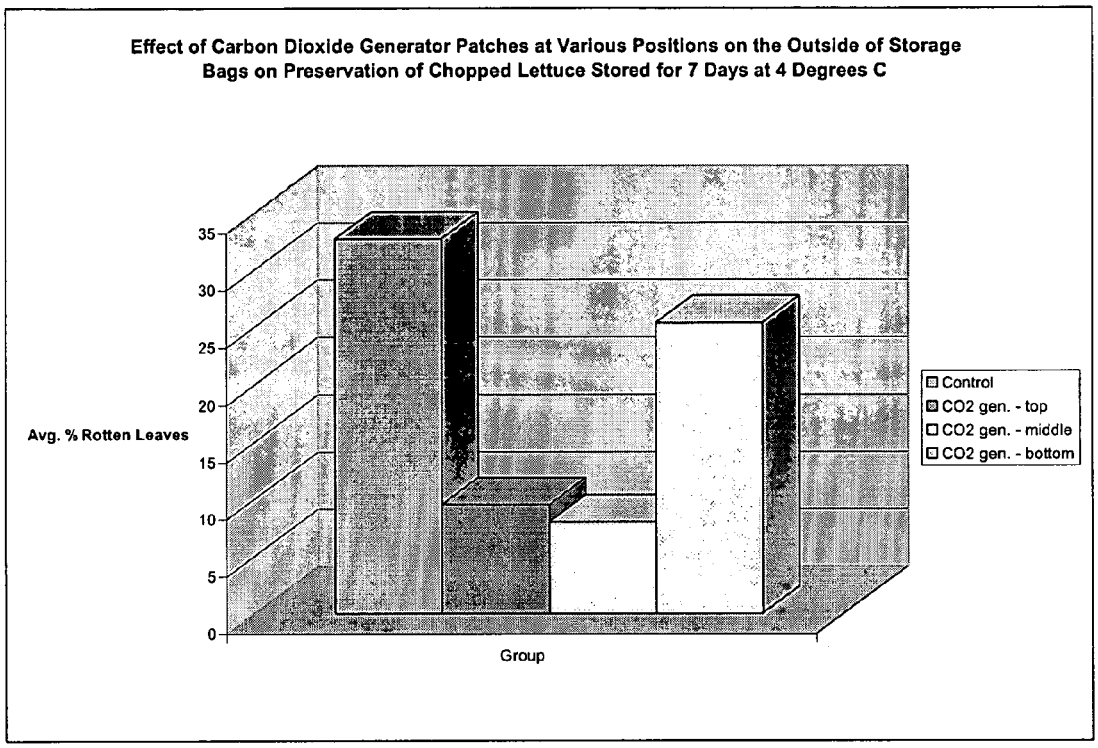
FIG. 5 shows effect of positioning of carbon dioxide patch position on preservation efficacy (chopped lettuce was stored in storage bags for seven days at 4° C.).

Surprisingly, the position of the patch on the bag also seemed to have an effect on efficacy, with performance being superior when the patch was positioned at either the middle of the bag or the top (see FIG. 5).

Example 2

Figure 6:
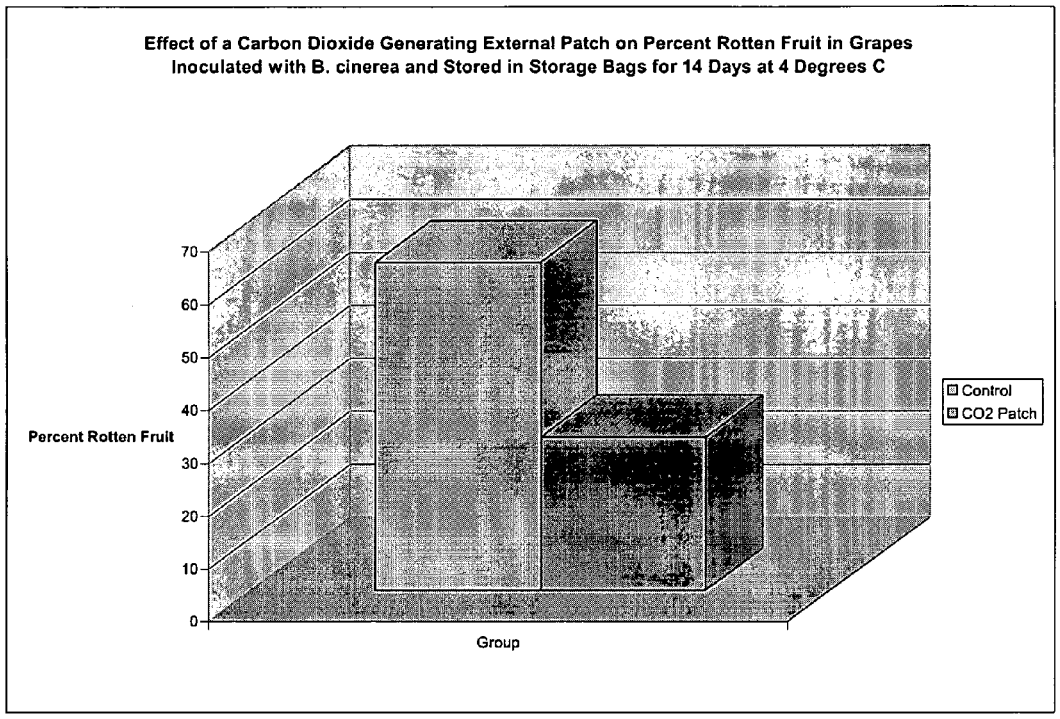
FIG. 6 shows the ability of an external carbon dioxide generating patch to preserve grapes inoculated with *Botrytis cinerea* and stored under refrigeration (14 days at 4° C.) in storage bags.
Figure 7:
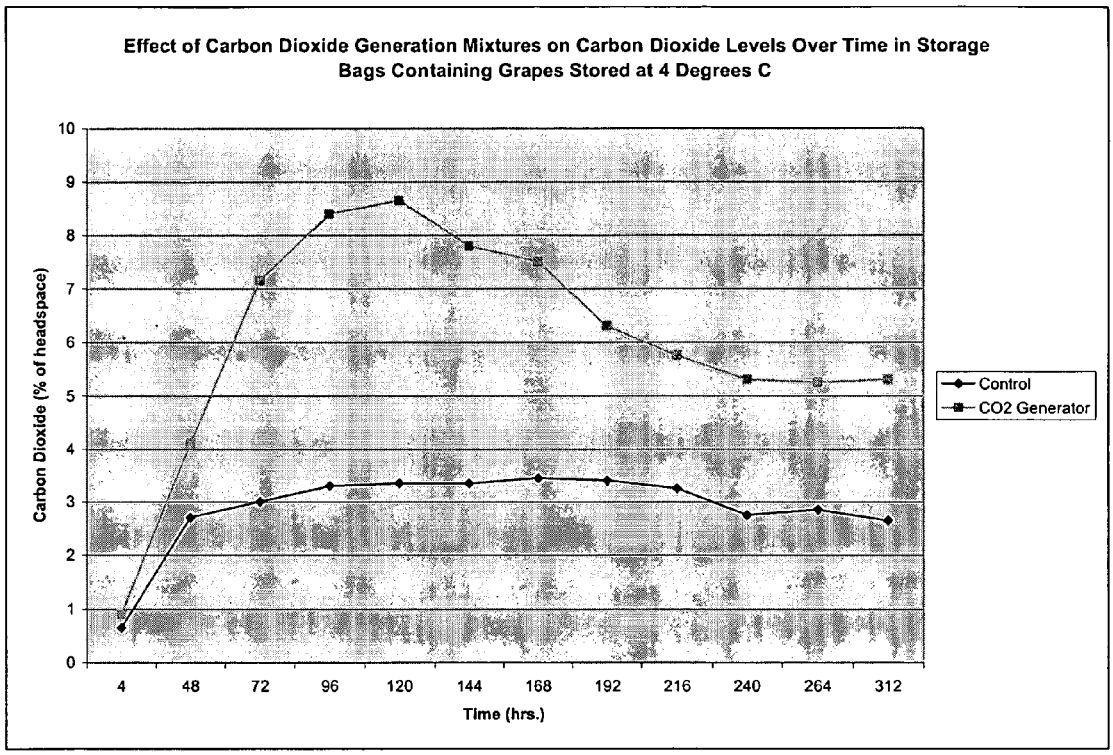
FIG. 7 shows the ability of a carbon dioxide generating patch to increase the level of carbon dioxide present in storage bags containing grapes inoculated with *Botrytis cinerea* stored under refrigeration (at 4° C.).

Experimentation was also directed toward determining whether or not carbon dioxide generation mixtures could be used to preserve store-bought fruit commodities. The patch and its contents in these experiments were identical to those described in Example 1. Grapes were used as the test commodity and were inoculated with the decay fungus *Botrytis cinerea* prior to storage in bags by immersion in a solution containing $1\times10^3$ spores/mL. Grapes were stored under refrigeration at 4° C. for an average of 14 days. They were assessed by simply deriving a percentage of rotten fruit by comparing the number of those exhibiting the symptoms of *B. cinerea* infection to the total number of grapes present in each bag (20 for most experiments). Surprisingly, the grapes stored in bags containing the external carbon dioxide generating patch were better preserved than were those in the control group bags (see FIG. 6). This result, like Example 1, was well correlated with increased carbon dioxide levels in the headspace of the bags (see FIG. 7).

All of the references cited herein are incorporated by reference in their entirety. Also incorporated by reference in their entirety are the following references: Active Food Packaging, edited by M. L. Rooney, 1995, Blackie Academic & Professional, New York, N.Y. (ISBN 0 7514 0191 9); Active Packaging for Food Applications, Aaron L. Brody, Eugene R. Strupinsky, and Lauir R. Kline, 2001, Technomic Publishing Company, Inc., Lancaster, Pa. (ISBN 1 58716 045 5). Also incorporated by reference in their entirety are the following U.S. Pat. Nos.: 4,263,079; 5,009,828; 5,070,584; 5,140,727; 5,647,100.

Thus, in view of the above, the present invention concerns (in part) the following:

A packaging system for preserving perishable items which comprises (or consists essentially of or consists of) a thermoplastic reclosable bag (or container) wherein said thermoplastic reclosable bag comprises (or consists essentially of or consists of) sealed means for closing one end of said thermoplastic reclosable bag (or container), and an external patch for delivering active packaging materials into said thermoplastic reclosable bag (or container), and means for flowing active packaging materials into said thermoplastic reclosable bag (or container) from said external patch into said thermoplastic reclosable bag (or container).

The above packaging system, wherein said exterior patch comprises (or consists essentially of or consists of) at least one layer of moisture absorbent material containing active packaging materials and at least one layer of gas and moisture impermeable plastic.

The above packaging system, wherein said exterior patch comprises (or consists essentially of or consists of) at least one layer of moisture absorbent material, at least one layer of active packaging materials, and at least one layer of gas and moisture impermeable plastic.

The above packaging system, wherein said means for flowing said chemicals from said exterior patch to said thermoplastic reclosable bag is an orifice communicating with said exterior patch and said thermoplastic reclosable bag or container.

The above packaging system, wherein said active packaging materials are selected from the group consisting of ethylene scavenging chemicals, oxygen scavengers, carbon dioxide generators, ethanol, volatile antimicrobial compounds, moisture absorbing compounds, and mixtures thereof.

The above packaging system, wherein said active packaging materials are at least one carboxyl acid and at least one base. The above packaging system, wherein said carboxyl acid is tartaric acid and wherein said base is sodium bicarbonate.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

I claim:

1. A packaging system for preserving perishable items which comprises a thermoplastic reclosable bag or container wherein said thermoplastic reclosable bag or container comprises sealed means for closing one end of said thermoplastic reclosable bag or container, and an external patch for delivering active packaging materials into said thermoplastic reclosable bag or container, and means for flowing active packaging materials into said thermoplastic reclosable bag or container from said external patch into said thermoplastic reclosable bag or container; wherein said exterior patch comprises at least one layer of moisture absorbent material, at least one layer of active packaging materials, and at least one layer of gas and moisture impermeable plastic, or wherein said exterior patch comprises at least one layer of moisture absorbent material containing active packaging materials and at least one layer of gas and moisture impermeable plastic.

2. The packaging system as recited in claim 1, wherein said means for flowing said chemicals from said exterior patch to said thermoplastic reclosable bag is an orifice communicating with said exterior patch and said thermoplastic reclosable bag or container.

3. The packaging system as recited in claim 1, wherein said active packaging materials are at least one carboxyl acid and at least one base.

4. The packaging system as recited in claim 3, wherein said carboxyl acid is tartaric acid and wherein said base is sodium bicarbonate.

5. The packaging system as recited in claim 1, wherein said active packaging materials are selected from the group consisting of ethylene scavenging chemicals, oxygen scavengers, carbon dioxide generators, ethanol, volatile antimicrobial compounds, moisture absorbing compounds, and mixtures thereof.

* * * * *